US010096278B2

(12) United States Patent
Kim et al.

(10) Patent No.: US 10,096,278 B2
(45) Date of Patent: Oct. 9, 2018

(54) METHOD OF DRIVING ORGANIC LIGHT EMITTING DISPLAY DEVICE

(71) Applicant: SAMSUNG DISPLAY CO., LTD., Yongin-si, Gyeonggi-do (KR)

(72) Inventors: Min Cheol Kim, Yongin-si (KR); In Hwan Kim, Yongin-si (KR); Byung Geun Jun, Yongin-si (KR)

(73) Assignee: SAMSUNG DISPLAY CO., LTD., Suwon-si, Gyeonggi-do (KR)

( * ) Notice: Subject to any disclaimer, the term of this patent is extended or adjusted under 35 U.S.C. 154(b) by 66 days.

(21) Appl. No.: 15/421,906

(22) Filed: Feb. 1, 2017

(65) Prior Publication Data

US 2017/0221408 A1 Aug. 3, 2017

(30) Foreign Application Priority Data

Feb. 2, 2016 (KR) ..... 10-2016-0012874

(51) Int. Cl.
*G09G 3/20* (2006.01)
*G09G 3/3208* (2016.01)

(52) U.S. Cl.
CPC ..... *G09G 3/2074* (2013.01); *G09G 3/3208* (2013.01); *G09G 2320/0276* (2013.01); *G09G 2320/0673* (2013.01)

(58) Field of Classification Search
CPC ..... G09G 3/3208; G09G 2320/0242
See application file for complete search history.

(56) References Cited

U.S. PATENT DOCUMENTS

2007/0052735 A1* 3/2007 Chou ..... H04N 9/69 345/690
2011/0080442 A1* 4/2011 Ghosh ..... G09G 3/2003 345/694

* cited by examiner

*Primary Examiner* — Christopher Kohlman
(74) *Attorney, Agent, or Firm* — Lee & Morse, P.C.

(57) ABSTRACT

A method for driving an organic light emitting display device includes measuring a characteristic of a panel and storing a measured loading correction value in a first look-up table. The measured loading correction value includes loading information of pixels that correspond to predetermined gray scale values based on the characteristic of the panel The method further includes storing gamma values of the pixels corresponding to the characteristic of the panel in a second lookup table, and obtaining a calculated loading correction value based on pre-stored equations, the first lookup table, and the second lookup table. The calculated loading correction value includes loading information corresponding to gray scale values different from the predetermined gray scale values.

13 Claims, 12 Drawing Sheets

FIG. 1

| Gray | Wsc | Rw | Gw | Bw | Wsum | Wdiff |
|---|---|---|---|---|---|---|
| 255 | 101.3698 | 23.6698 | 31.9698 | 57.7698 | 113.4094 | 111.8769 |
| 250 | 98.5886 | 22.6698 | 30.5698 | 55.4698 | 108.7094 | 110.2657 |
| 230 | 80.5886 | 18.2698 | 24.3198 | 45.5198 | 88.1094 | 109.3324 |
| 210 | 64.7886 | 14.1698 | 18.8698 | 36.6698 | 69.7094 | 107.5952 |
| 190 | 51.1886 | 10.9698 | 14.5698 | 28.9698 | 54.5094 | 106.4875 |
| 170 | 39.1886 | 8.2698 | 10.9698 | 22.2698 | 41.5094 | 105.9222 |
| 150 | 29.5886 | 6.0698 | 8.1198 | 16.6698 | 30.8594 | 104.2950 |
| 130 | 21.1886 | 4.1698 | 5.7698 | 12.0698 | 22.0094 | 103.8740 |
| 110 | 14.6698 | 2.8698 | 3.7698 | 8.2698 | 14.9094 | 101.6333 |
| 90 | 9.7698 | 1.7198 | 2.4698 | 5.5698 | 9.7594 | 99.8935 |
| 70 | 5.4198 | 0.9698 | 1.2698 | 3.0698 | 5.3094 | 97.9630 |
| 50 | 2.2698 | 0.3698 | 0.5698 | 1.4698 | 2.4094 | 106.1503 |
| 30 | 0.8198 | 0.0000 | 0.1698 | 0.3698 | 0.5396 | 65.8209 |
| 10 | 0.1698 | 0.0000 | 0.0000 | 0.0000 | 0.0000 | 0.0000 |

FIG. 2

| R | G | B | Wsum | Wsc | Rw | Gw | Bw | RofW | GofW | BofW | Rws | Gws | Bws | Rdiff | Gdiff | BRdiff |
|---|---|---|---|---|---|---|---|---|---|---|---|---|---|---|---|---|
| 255 | 255 | 255 | 113.409 | 101.3698 | 23.6698 | 31.9698 | 57.7698 | 0.2087 | 0.2819 | 0.5094 | 21.1570 | 28.5759 | 51.6369 | 111.88 | 111.88 | 111.88 |
| 255 | 250 | 255 | 112.009 | 100.0698 | 23.6698 | 30.5698 | 57.7698 | 0.2113 | 0.2729 | 0.5158 | 21.1467 | 27.3112 | 51.6118 | 111.93 | 111.93 | 111.93 |
| 255 | 230 | 255 | 105.759 | 95.3198 | 23.6698 | 24.3198 | 57.7698 | 0.2238 | 0.2300 | 0.5462 | 21.3333 | 21.9192 | 52.0673 | 110.95 | 110.95 | 110.95 |
| 255 | 210 | 255 | 100.309 | 91.1698 | 23.6698 | 18.8698 | 57.7698 | 0.2360 | 0.1881 | 0.5759 | 21.5131 | 17.1505 | 52.5062 | 110.02 | 110.02 | 110.02 |
| 255 | 190 | 255 | 96.0094 | 87.9198 | 23.6698 | 14.5698 | 57.7698 | 0.2465 | 0.1518 | 0.6017 | 21.6754 | 13.3422 | 52.9022 | 109.20 | 109.20 | 109.20 |
| 255 | 170 | 255 | 92.4094 | 85.1698 | 23.6698 | 10.9698 | 57.7698 | 0.2561 | 0.1187 | 0.6252 | 21.8154 | 10.1104 | 53.2440 | 108.50 | 108.50 | 108.50 |
| 255 | 150 | 255 | 89.5594 | 83.1198 | 23.6698 | 8.1198 | 57.7698 | 0.2643 | 0.0907 | 0.6450 | 21.9679 | 7.5360 | 53.6160 | 107.75 | 107.75 | 107.75 |
| 255 | 130 | 255 | 87.2094 | 81.4698 | 23.6698 | 5.7698 | 57.7698 | 0.2714 | 0.0662 | 0.6624 | 22.1120 | 5.3901 | 53.9677 | 107.05 | 107.05 | 107.05 |
| 255 | 110 | 255 | 85.2094 | 80.0198 | 23.6698 | 3.7698 | 57.7698 | 0.2778 | 0.0442 | 0.6780 | 22.2282 | 3.5402 | 54.2514 | 106.49 | 106.49 | 106.49 |
| 255 | 90 | 255 | 83.9094 | 79.1698 | 23.6698 | 2.4698 | 57.7698 | 0.2821 | 0.0294 | 0.6885 | 22.3328 | 2.3303 | 54.5067 | 105.99 | 105.99 | 105.99 |
| 255 | 70 | 255 | 82.7094 | 78.5698 | 23.6698 | 1.2698 | 57.7698 | 0.2862 | 0.0154 | 0.6985 | 22.4851 | 1.2062 | 54.8784 | 105.27 | 105.27 | 105.27 |
| 255 | 50 | 255 | 82.0094 | 78.1698 | 23.6698 | 0.5698 | 57.7698 | 0.2886 | 0.0069 | 0.7044 | 22.5616 | 0.5431 | 55.0651 | 104.91 | 104.91 | 104.91 |
| 255 | 30 | 255 | 81.6094 | 77.8698 | 23.6698 | 0.1698 | 57.7698 | 0.2900 | 0.0021 | 0.7079 | 22.5852 | 0.1620 | 55.1226 | 104.80 | 104.80 | 104.80 |
| 255 | 10 | 255 | 81.4396 | 77.9698 | 23.6698 | 0.0000 | 57.7698 | 0.2906 | 0.0000 | 0.7094 | 22.6613 | 0.0000 | 55.3085 | 104.45 | 0.00 | 104.45 |

FIG. 3

| R | G | B | Wsum | Wsc | Rw | Gw | Bw | RofW | GofW | BofW | Rws | Gws | Bws | Rdiff | Gdiff | Bdiff |
|---|---|---|---|---|---|---|---|---|---|---|---|---|---|---|---|---|
| 150 | 255 | 255 | 95.8094 | 87.7698 | 6.0698 | 31.9698 | 57.7698 | 0.0634 | 0.3337 | 0.6030 | 5.5605 | 29.2871 | 52.9222 | 109.16 | 109.16 | 109.16 |
| 150 | 250 | 255 | 94.4094 | 86.2698 | 6.0698 | 30.5698 | 57.7698 | 0.0634 | 0.3238 | 0.6119 | 5.5465 | 27.9342 | 52.7891 | 109.44 | 109.44 | 109.44 |
| 150 | 230 | 255 | 88.1594 | 81.2698 | 6.0698 | 24.3198 | 57.7698 | 0.0689 | 0.2759 | 0.6553 | 5.5954 | 22.4192 | 53.2551 | 108.48 | 108.48 | 108.48 |
| 150 | 210 | 255 | 82.7094 | 76.8698 | 6.0698 | 18.8698 | 57.7698 | 0.0734 | 0.2281 | 0.6985 | 5.6412 | 17.5375 | 53.6910 | 107.60 | 107.60 | 107.60 |
| 150 | 190 | 255 | 78.4094 | 73.3698 | 6.0698 | 14.5698 | 57.7698 | 0.0774 | 0.1858 | 0.7368 | 5.6797 | 13.6334 | 54.0568 | 106.87 | 106.87 | 106.87 |
| 150 | 170 | 255 | 74.8094 | 70.6698 | 6.0698 | 10.9698 | 57.7698 | 0.0811 | 0.1466 | 0.7722 | 5.7339 | 10.3628 | 54.5731 | 105.86 | 105.86 | 105.86 |
| 150 | 150 | 255 | 71.9594 | 68.3698 | 6.0698 | 8.1198 | 57.7698 | 0.0844 | 0.1128 | 0.8028 | 5.7670 | 7.7148 | 54.8880 | 105.25 | 105.25 | 105.25 |
| 150 | 130 | 255 | 69.6094 | 66.6698 | 6.0698 | 5.7698 | 57.7698 | 0.0872 | 0.0829 | 0.8299 | 5.8135 | 5.5261 | 55.3302 | 104.41 | 104.41 | 104.41 |
| 150 | 110 | 255 | 67.6094 | 65.0698 | 6.0698 | 3.7698 | 57.7698 | 0.0898 | 0.0558 | 0.8545 | 5.8418 | 3.6282 | 55.5998 | 103.90 | 103.90 | 103.90 |
| 150 | 90 | 255 | 66.3094 | 64.3198 | 6.0698 | 2.4698 | 57.7698 | 0.0915 | 0.0372 | 0.8712 | 5.8877 | 2.3957 | 56.0364 | 103.09 | 103.09 | 103.09 |
| 150 | 70 | 255 | 65.1094 | 63.4698 | 6.0698 | 1.2698 | 57.7698 | 0.0932 | 0.0195 | 0.8873 | 5.9169 | 1.2378 | 56.3150 | 102.58 | 102.58 | 102.58 |
| 150 | 50 | 255 | 64.4094 | 62.8198 | 6.0698 | 0.5698 | 57.7698 | 0.0942 | 0.0088 | 0.8969 | 5.9200 | 0.5557 | 56.3441 | 102.53 | 105.53 | 102.53 |
| 150 | 30 | 255 | 64.0094 | 62.5698 | 6.0698 | 0.1698 | 57.7698 | 0.0948 | 0.0027 | 0.9025 | 5.9333 | 0.1660 | 56.4705 | 102.30 | 102.30 | 102.30 |
| 150 | 10 | 255 | 63.8396 | 62.5698 | 6.0698 | 0.0000 | 57.7698 | 0.0951 | 0.0000 | 0.9049 | 5.9491 | 0.0000 | 56.6207 | 102.03 | 0.00 | 102.03 |

1.70

| R | G | B | Ldiff | Ldiff(C) |
|---|---|---|---|---|
| 255 | 255 | 255 | 111.877 | 111.877 |
| 250 | 255 | 255 | 111.661 | 111.716 |
| 230 | 255 | 255 | 111.213 | 111.096 |
| 210 | 255 | 255 | 110.460 | 110.519 |
| 190 | 255 | 255 | 110.101 | 109.985 |
| 170 | 255 | 255 | 109.545 | 109.496 |
| 150 | 255 | 255 | 109.160 | 109.053 |
| 130 | 255 | 255 | 108.478 | 108.659 |
| 110 | 255 | 255 | 108.417 | 108.317 |
| 90 | 255 | 255 | 108.019 | 108.031 |
| 70 | 255 | 255 | 107.770 | 107.804 |
| 50 | 255 | 255 | 107.568 | 107.646 |
| 30 | 255 | 255 | 107.576 | 107.576 |
| 10 | 255 | 255 | 107.640 | |

1.50

| R | G | B | Ldiff | Ldiff(C) |
|---|---|---|---|---|
| 255 | 255 | 255 | 111.877 | 111.877 |
| 255 | 250 | 255 | 111.931 | 111.642 |
| 255 | 230 | 255 | 110.952 | 110.731 |
| 255 | 210 | 255 | 110.025 | 109.865 |
| 255 | 190 | 255 | 109.201 | 109.045 |
| 255 | 170 | 255 | 108.500 | 108.275 |
| 255 | 150 | 255 | 107.747 | 107.558 |
| 255 | 130 | 255 | 107.045 | 106.899 |
| 255 | 110 | 255 | 106.485 | 106.302 |
| 255 | 90 | 255 | 105.987 | 105.777 |
| 255 | 70 | 255 | 105.269 | 105.333 |
| 255 | 50 | 255 | 104.912 | 104.99 |
| 255 | 30 | 255 | 104.802 | 104.802 |
| 255 | 10 | 255 | 104.450 | |

1.00

| R | G | B | Ldiff | Ldiff(C) |
|---|---|---|---|---|
| 255 | 255 | 255 | 111.877 | 111.877 |
| 255 | 255 | 250 | 111.702 | 111.762 |
| 255 | 255 | 230 | 111.323 | 111.301 |
| 255 | 255 | 210 | 110.856 | 110.841 |
| 255 | 255 | 190 | 110.717 | 110.38 |
| 255 | 255 | 170 | 110.244 | 109.919 |
| 255 | 255 | 150 | 109.776 | 109.459 |
| 255 | 255 | 130 | 109.350 | 108.998 |
| 255 | 255 | 110 | 108.745 | 108.538 |
| 255 | 255 | 90 | 108.393 | 108.077 |
| 255 | 255 | 70 | 107.487 | 107.616 |
| 255 | 255 | 50 | 107.007 | 107.156 |
| 255 | 255 | 30 | 106.695 | 106.695 |
| 255 | 255 | 10 | 106.447 | |

FIG. 7

| R | G | B |
|---|---|---|
| 1.70 | 1.50 | 1.00 |

| R | G | B | Ldiff |
|---|---|---|---|
| FIRST GRAY (255) | FIRST GRAY (255) | FIRST GRAY (255) | 111.877 |
| SECOND GRAY (30) | FIRST GRAY (255) | FIRST GRAY (255) | 107.576 |
| FIRST GRAY (255) | SECOND GRAY (30) | FIRST GRAY (255) | 104.802 |
| FIRST GRAY (255) | FIRST GRAY (255) | SECOND GRAY (30) | 106.695 |

FIG. 8

| R | G | B | Wsum | Wsc | Rw | Gw | Bw | Rws | Gws | Bws | Cal1 | Cal2 | Cal3 | Ldiff | Ldiff(C) | Error |
|---|---|---|---|---|---|---|---|---|---|---|---|---|---|---|---|---|
| 255 | 255 | 255 | 113.409 | 101.3698 | 23.6698 | 31.9698 | 57.7698 | 21.1570 | 28.5759 | 51.6369 | 111.88 | 111.88 | 111.88 | 111.88 | 111.88 | 100.00 |
| 255 | 250 | 255 | 112.009 | 100.0698 | 23.6698 | 30.5698 | 57.7698 | 21.1467 | 27.3112 | 51.6118 | 111.88 | 111.64 | 111.64 | 111.93 | 111.64 | 99.74 |
| 255 | 230 | 255 | 105.759 | 95.3198 | 23.6698 | 24.3198 | 57.7698 | 21.3333 | 21.9192 | 52.0673 | 111.88 | 110.73 | 110.73 | 110.95 | 110.73 | 99.80 |
| 255 | 210 | 255 | 100.309 | 91.1698 | 23.6698 | 18.8698 | 57.7698 | 21.5131 | 17.1505 | 52.5062 | 111.88 | 109.86 | 109.86 | 110.02 | 109.86 | 99.85 |
| 255 | 190 | 255 | 96.0094 | 87.9198 | 23.6698 | 14.5698 | 57.7698 | 21.6754 | 13.3422 | 52.9022 | 111.88 | 109.04 | 109.04 | 109.20 | 109.04 | 99.86 |
| 255 | 170 | 255 | 92.4094 | 85.1698 | 23.6698 | 10.9698 | 57.7698 | 21.8154 | 10.1104 | 53.2440 | 111.88 | 108.27 | 108.27 | 108.50 | 108.27 | 99.79 |
| 255 | 150 | 255 | 89.5594 | 83.1198 | 23.6698 | 8.1198 | 57.7698 | 21.9679 | 7.5360 | 53.6160 | 111.88 | 107.56 | 107.56 | 107.75 | 107.56 | 99.82 |
| 255 | 130 | 255 | 87.2094 | 81.4698 | 23.6698 | 5.7698 | 57.7698 | 22.1120 | 5.3901 | 53.9677 | 111.88 | 106.90 | 106.90 | 107.05 | 106.90 | 99.86 |
| 255 | 110 | 255 | 85.2094 | 80.0198 | 23.6698 | 3.7698 | 57.7698 | 22.2282 | 3.5402 | 54.2514 | 111.88 | 106.30 | 106.30 | 106.49 | 106.30 | 99.83 |
| 255 | 90 | 255 | 83.9094 | 79.1698 | 23.6698 | 2.4698 | 57.7698 | 22.3328 | 2.3303 | 54.5067 | 111.88 | 105.78 | 105.78 | 105.99 | 105.78 | 99.80 |
| 255 | 70 | 255 | 82.7094 | 78.5698 | 23.6698 | 1.2698 | 57.7698 | 22.4851 | 1.2062 | 54.8784 | 111.88 | 105.33 | 105.33 | 105.27 | 105.33 | 100.06 |
| 255 | 50 | 255 | 82.0094 | 78.1698 | 23.6698 | 0.5698 | 57.7698 | 22.5616 | 0.5431 | 55.0651 | 111.88 | 104.99 | 104.99 | 104.91 | 104.99 | 100.07 |
| 255 | 30 | 255 | 81.6094 | 77.8698 | 23.6698 | 0.1698 | 57.7698 | 22.5852 | 0.1620 | 55.1226 | 111.88 | 104.80 | 104.80 | 104.80 | 104.80 | 100.00 |

FIG. 9

| R | G | B | Wsum | Wsc | Rw | Gw | Bw | Rws | Gws | Bws | Cal1 | Cal2 | Cal3 | Ldiff | Ldiff(C) | Error |
|---|---|---|---|---|---|---|---|---|---|---|---|---|---|---|---|---|
| 255 | 255 | 170 | 77.9094 | 70.6698 | 23.6698 | 31.9698 | 22.2698 | 21.4703 | 28.9991 | 20.2004 | 111.88 | 111.88 | 109.92 | 110.24 | 109.92 | 99.71 |
| 255 | 250 | 170 | 76.5094 | 70.0886 | 23.6698 | 30.5698 | 22.2698 | 21.6834 | 28.0043 | 20.4009 | 111.88 | 111.64 | 109.69 | 109.16 | 109.69 | 100.48 |
| 255 | 230 | 170 | 70.2594 | 64.7886 | 23.6698 | 24.3198 | 22.2698 | 21.8267 | 22.4261 | 20.5357 | 111.88 | 110.73 | 108.79 | 108.44 | 108.79 | 100.32 |
| 255 | 210 | 170 | 64.8094 | 59.9886 | 23.6698 | 18.8698 | 22.2698 | 21.9091 | 17.4662 | 20.6133 | 111.88 | 109.86 | 107.94 | 108.04 | 107.94 | 99.91 |
| 255 | 190 | 170 | 60.5094 | 56.3886 | 23.6698 | 14.5698 | 22.2698 | 22.0578 | 13.5776 | 20.7532 | 111.88 | 109.04 | 107.14 | 107.31 | 107.14 | 99.84 |
| 255 | 170 | 170 | 56.9094 | 53.1886 | 23.6698 | 10.9698 | 22.2698 | 22.1222 | 10.2526 | 20.8138 | 111.88 | 108.27 | 106.38 | 107.00 | 106.38 | 99.42 |
| 255 | 150 | 170 | 54.0594 | 51.0386 | 23.6698 | 8.1198 | 22.2698 | 22.3471 | 7.6661 | 21.0254 | 111.88 | 107.56 | 105.68 | 105.92 | 105.68 | 99.77 |
| 255 | 130 | 170 | 51.7094 | 49.0386 | 23.6698 | 5.7698 | 22.2698 | 22.4472 | 5.4718 | 21.1195 | 111.88 | 106.90 | 105.03 | 105.45 | 105.03 | 99.60 |
| 255 | 110 | 170 | 49.7094 | 47.5886 | 23.6698 | 3.7698 | 22.2698 | 22.6599 | 3.6090 | 21.3197 | 111.88 | 106.30 | 104.44 | 104.46 | 104.44 | 99.99 |
| 255 | 90 | 170 | 48.4094 | 46.0698 | 23.6698 | 2.4698 | 22.2698 | 22.5259 | 2.3504 | 21.1935 | 111.88 | 105.78 | 103.93 | 105.08 | 103.93 | 98.90 |
| 255 | 70 | 170 | 47.2094 | 45.1698 | 23.6698 | 1.2698 | 22.2698 | 22.6472 | 1.2149 | 21.3077 | 111.88 | 105.33 | 103.49 | 104.52 | 103.49 | 99.02 |
| 255 | 50 | 170 | 46.5094 | 44.6198 | 23.6698 | 0.5698 | 22.2698 | 22.7081 | 0.5466 | 21.3650 | 111.88 | 104.99 | 103.15 | 104.23 | 103.15 | 99.96 |
| 255 | 30 | 170 | 46.1094 | 44.3698 | 23.6698 | 0.1698 | 22.2698 | 22.7768 | 0.1634 | 214296 | 111.88 | 104.80 | 102.97 | 103.92 | 102.97 | 99.08 |

METHOD OF DRIVING ORGANIC LIGHT EMITTING DISPLAY DEVICE

CROSS-REFERENCE TO RELATED APPLICATION

Korean Patent Application No. 10-2016-0012874, filed on Feb. 2, 2016, and entitled, "Method of Driving Organic Light Emitting Display Device," is incorporated by reference herein in its entirety.

BACKGROUND

1. Field

One or more embodiments described herein relate to a method for driving an organic light emitting display device.

2. Description of the Related Art

A variety of displays have been developed. Examples include liquid crystal displays and organic light emitting displays. An organic light emitting display generates images based on light emitted from organic light emitting diodes. The light is emitted based on a recombination of electrons and holes in an organic active layer of each diode.

In an organic light emitting display, each pixel charges a voltage corresponding to a data signal in at least one capacitor. Current corresponding to the charged voltage is then supplied from a first power source to a second power source, via an organic light emitting diode, using a driving transistor. The load of the display may change based on an emission ratio of red, green, and blue pixels. This change may degrade the luminance characteristics of the display.

SUMMARY

In accordance with one or more embodiments, a method for driving an organic light emitting display device includes measuring a characteristic of a panel; storing a measured loading correction value in a first look-up table, the measured loading correction value including loading information of red pixels, green pixels, and blue pixels that correspond to predetermined gray scale values based on the characteristic of the panel; storing a first gamma value of the red pixels corresponding to the characteristic of the panel, a second gamma value of the green pixels corresponding to the characteristic of the panel, and a third gamma value of the blue pixels corresponding to the characteristic of the panel in a second lookup table; and obtaining a calculated loading correction value based on pre-stored equations, the first lookup table, and the second lookup table, the calculated loading correction value including loading information corresponding to gray scale values different from the predetermined gray scale values.

The measured loading correction value and the calculated loading correction value may include difference information between a loading value when all of the red pixels, the green pixels, and the blue pixels emit light and a loading value when each of the red pixels, the green pixels, and the blue pixels emits light.

Difference information between a first current flowing when all of the red pixels, the green pixels, and the blue pixels emit light and second currents flowing when each of the red pixels, the green pixels, and the blue pixels emits light may correspond to the measured loading correction value.

The first gamma value may be generated based on a measurement curve of a current change that corresponds to a gray scale value change of the red pixels when gray scale values of the green pixels and the blue pixels are fixed. The second gamma value may be generated based on a measurement curve of a current change that corresponds to a gray scale value change of the green pixels when gray scale values of the red pixels and the blue pixels are fixed. The third gamma value may be generated based on a measurement curve of a current change that corresponds to a gray scale value change of the blue pixels when grays of the red pixels and the green pixels are fixed.

The first lookup table may include a first measured loading correction value when the red pixels, the green pixels, and the blue pixels emit light of a first gray scale value, and second measured loading correction values when any one of the red pixels, the green pixels, or the blue pixels emit light of a second gray scale value and remaining ones of the pixels emit light of the first gray scale value. The first gray scale value may be set with a highest gray value and the second gray scale value may be set with a gray scale value between an intermediate gray value and a lowest gray value. When maximum gray scale value is 255, the first gray scale value may correspond to 255 and the second gray scale value may be between 20 to 50.

The calculated loading correction value may be based on the following equations:

$$Cal1=(Ldiff_{maxR}-Ldiff_{minR})\times((GrayR-Gray_{min})/(Gray_{max}-Gray_{min}))^{Rgamma}+Ldiff_{minR}$$

where $Ldiff_{maxR}$ corresponds to a first measured loading correction value of the red pixels, $Ldiff_{minR}$ corresponds to a second measured loading correction value of the red pixels, GrayR corresponds to a gray value of data currently input into the red pixels, $Gray_{min}$ corresponds to the second gray value, $Gray_{max}$ means the first gray value, and Rgamma means the first gamma value, $$Cal2=(Cal1-Ldiff_{minG}\times(Cal1/Ldiff_{maxR}))\times((GrayG-Gray_{min})/(Gray_{max}-Gray_{min}))^{Ggamma}+(Ldiff_{minG}\times(Cal1/Ldiff_{maxR}))$$

where $Ldiff_{minG}$ corresponds to a second measured loading correction value of the green pixels, GrayG corresponds to a gray value of data currently input into the green pixels, and Ggamma corresponds to the second gamma value.

$$Cal3(Ldiff(C))=(Cal2-Ldiff_{minB}\times(Cal2/Cal1))\times((GrayB-Gray_{min})/(Gray_{max}-Gray_{min}))^{Bgamma}+(Ldiff_{minB}\times(Cal2/Cal1))$$

where $Ldiff_{minB}$ corresponds to a second measured loading correction value of the blue pixels, GrayB corresponds to a gray value of data currently input into the blue pixels, and Bgamma corresponds to the third gamma value.

The method may include generating second data by changing a bit of first data supplied from an external source based on the calculated loading correction value. The method may include calculating a current, in which a loading effect is excluded, from a current supplied from the pixels based on the calculated loading correction value.

BRIEF DESCRIPTION OF THE DRAWINGS

Features will become apparent to those of skill in the art by describing in detail exemplary embodiments with reference to the attached drawings in which:

FIG. 1 illustrates an example of current values corresponding to loading of a panel when red pixels, green pixels, and blue pixels implement the same gray value;

FIG. 2 illustrates an example of current values corresponding to loading of a panel when red and blue pixels implement the same gray value and green pixels implement a different gray value;

FIG. 3 illustrates an embodiment of current values corresponding to loading of a panel when red pixels implement 150 gray scale values, blue pixels implement 255 gray scale values, and green pixels have different gray scale values;

FIG. 7 illustrates an embodiment corresponding to an equation extracted from FIGS. 4 to 6;

FIG. 8 illustrates an example of a difference between a measured loading correction value and a calculated loading correction value when gray scale values of red and blue pixels are fixed and gray scale values of green pixels are different;

FIG. 9 illustrates another example of a difference between a measured loading correction value and a calculated loading correction value when gray scale values of red and blue pixels are fixed and gray scale values of green pixels are different;

DETAILED DESCRIPTION

Figure 4:
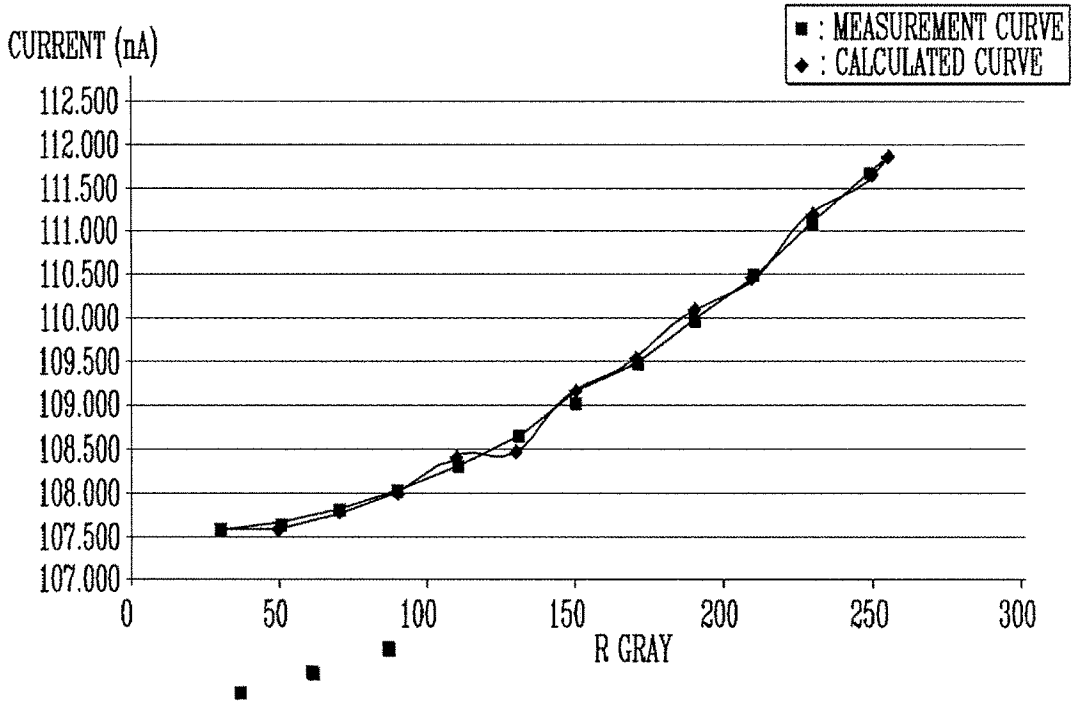
FIG. 4 illustrates an example of current change values when gray scale values of green and blue pixels are fixed and gray scale values of red pixels are different.

Example embodiments will be described with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an example of current values corresponding to loading of a panel when red, green, and blue pixels implement the same gray scale value. Referring to FIG. 1, current in a self-emitting display (e.g., an organic light emitting display device) is proportional to luminance, and loading of the panel may be represented by current.

In FIG. 1, the term "gray" corresponds to a gray scale value of data, Wsc corresponds to current values when the red, green, and blue pixels emit light of corresponding gray scale values, Rw corresponds to current values when red pixels emit light of corresponding gray scale values, Gw corresponds to current values when green pixels emit light of corresponding gray scale values, Bw corresponds to current values when blue pixels emit light of corresponding gray scale values, Wsum corresponds to current values obtained by adding Rw, Gw, and Bw for each corresponding gray scale value, and Wdiff represents a different ratio of Wsc and Wsum.

When the red, green, and blue pixels emit light corresponding to a 255 gray scale value, the current Wsc flowing in the panel may be set with 101.3598 nA. When the red pixels emit light corresponding to a 255 gray scale value, a current Rw flowing in the panel is set with 23.6698 nA. When the green pixels emit light corresponding to a 255 gray scale value, a current Gw flowing in the panel is set with 31.9698 nA. When the blue pixels emit light corresponding to a 255 gray scale value, a current Bw flowing in the panel is set with 57.7698 nA.

When the pixels emit light corresponding to a 255 gray scale value, the sum Wsum of the current Rw flowing in the red pixels, the current Gw flowing in the green pixels, and the current Bw flowing in the blue pixels is set to 113.4094 nA.

Ideally, the values of Wsc and Wsum corresponding to a 255 gray scale value are to be identically set. However, Wsc and Wsum may be set with different values when a loading change occurs in the panel based on the emission ratio of the pixels. For example, the loading of the panel when each of the red pixels, the green pixels, and the blue pixels emits light is differently set from the loading of the panel when all of the red pixels, the green pixels, and the blue pixels emit light. Thus, Wsum and Wsc are set with different current values. When Wsc is set with 100% for the 255 gray scale value, the ratio of Wsum (e.g., Wdiff) is set with 111.8769.

Using the aforementioned method, it is possible to extract a value of Wdiff corresponding to each of the gray scale values (250, 230, 210, 190, 170, . . . ). For example, Wdiff may be set with 110.2657 corresponding to the 250 gray scale value, 109.3324 corresponding to the 230 gray scale value, 107.5952 corresponding to the 210 gray scale value, 106.4875 corresponding to the 190 gray scale value, 105.9222 corresponding to the 170 gray scale value, 104.2950 corresponding to the 150 gray scale value, 103.8740 corresponding to the 130 gray scale value, 101.6333 corresponding to the 110 gray scale value, 99.8935 corresponding to the 90 gray scale value, 97.9630 corresponding to the 70 gray scale value, 106.1503 corresponding to the 50 gray scale value, and 65.8209 corresponding to the 30 gray scale value.

When the panel is driven with a low gray scale value (e.g., a gray scale value of 10 or lower), the current value flowing in the panel decreases. When the current value flowing in the panel is small (e.g., as described above), current sensing accuracy of the measurement equipment may diminish. As a result, it may be difficult to accurately measure current values.

In FIG. 1, extracted Wdiff represents a loading difference of the panel when all or each of the red pixels, the green pixels, and the blue pixels emits light in for corresponding gray scale values.

FIG. 2 illustrates an example of a current values corresponding to loading of the panel when the gray scale values of the red and blue pixels are the same and the gray scale values of the green pixels are different.

Referring to FIG. 2, the red pixels R and the blue pixels B emit light corresponding to a gray scale value of 255 and the green pixels G emit light corresponding to gray scale values that gradually decrease from 255 to 10. When the red pixels R, the green pixels G, and the blue pixels B emit light corresponding to the gray scale value of 255, Wsum may be set with 113.409 nA, Rw may be set with 23.6698 nA, Gw may be set with 31.9698 nA, Bw may be set with 57.7698 nA, and Wsc may be set with 101.3698 nA.

The value of current Gw flowing when the green pixels G emit light changes based on the gray scale value to be expressed. For example, the current Gw flowing when the green pixels G emit light corresponding to a gray scale value of 250 is set with 30.5698 nA, the current Gw flowing when the green pixels G emit light corresponding to a gray scale value of 230 is set with 24.3198 nA, and the current Gw flowing when the green pixels G emit light corresponding to a gray scale value of 30 is set with 0.1698 nA.

The current Gw flowing to the green pixels G changes with gray scale value. As a result, the current values of Wsum and Wsc also change when the gray scale value to be expressed in the green pixels G changes. An example of changed gray scale values are illustrated in FIG. 2.

In one embodiment, a gamma value may be applied to data signals that correspond to gray scale values for the red pixel R, the green pixel G, and the blue pixel B. For example, white in the panel may be implemented by adjusting the emission ratio of the red pixels R, the green pixels G, and the blue pixels B using gamma values.

Accordingly, when Rw is divided by Wsum, self efficiency of the red pixels R and a current ratio RofW of the red pixels corresponding to the gamma may be recognized. Further, when Gw is divided by Wsum, self efficiency of the green pixels G and a current ratio GofW of the green pixels corresponding to the gamma may be recognized. Similarly, when Bw is divided by Wsum, self efficiency of the blue pixels B and a current ratio BofW of the blue pixels corresponding to the gamma may be recognized.

For example, when all of the red pixels R, the green pixels G, and the blue pixels B emit light corresponding to a gray scale value of 255, RofW is set with 0.2087, GofW is set with 0.2819, and BofW is set with 0.5094. When the red pixels R and the blue pixels B emit light corresponding to a gray scale value of 255 and the green pixels G emit light corresponding to a gray scale value of 250, RofW is set with 0.2113, GofW is set with 0.2729, and BofW is set with 0.5158. Examples of the values of RofW, GofW, and BofW corresponding to changes of the gray scale values of the green pixels G are illustrated in FIG. 2.

When RofW is multiplied by Wsc, it is possible to obtain an ideal current Rws, except for a loading effect, when only the red pixels R emit light. When GofW is multiplied by Wsc, it is possible to obtain an ideal current Gws, except for a loading effect, when only the green pixels G emit light. When BofW is multiplied by Wsc, it is possible to obtain an ideal current Bws, except for a loading effect, when only the blue pixels B emit light.

For example, when all of the red pixels R, the green pixels G, and the blue pixels B emit light corresponding to a gray scale value of 255, Rws is set with 21.1570 nA, Gws is set with 28.5759 nA, and Bws is set with 51.6369 nA. When the red pixels R and the blue pixels B emit light corresponding to a gray scale value of 255 and the green pixels G emit light corresponding to a gray scale value of 250, Rws is set with 21.1467 nA, Gws is set with 27.3112 nA, and Bws is set with 51.6118 nA. An example of values corresponding to changes in gray scale values for the green pixels G are illustrated in FIG. 2.

When Rws is set with 100%, the ratio of Rw may be represented with Rdiff (R difference ratio). When Gws is set with 100%, a ratio of Gw may be represented with Gdiff (G difference ratio). When Bws is set with 100%, a ratio of Bw may be represented with Bdiff (B difference ratio).

When all of the red pixels R, the green pixels G, and the blue pixels B emit light corresponding to a gray scale value of 255, Rdiff, Gdiff, and Bdiff are set with 111.88. Further, when the red pixels R and the green pixels G emit light corresponding to a gray scale value of 255 and the blue pixels B emit light corresponding to a gray scale value of 250, Rdiff, Gdiff, and Bdiff are set with 111.93. When the red pixels R and the green pixels G emit light corresponding to a gray scale value of 255 and the blue pixels B emit light corresponding to a gray scale value of 150, Rdiff, Gdiff, and Bdiff are set with 107.75.

In one embodiment. Rdiff, Gdiff, and Bdiff are equally set for remaining gray scale values, except for a gray scale value of 10 for the green pixels G where the current sensing accuracy of measurement equipment may be diminished. When Rdiff, Gdiff, and Bdiff are equally set for corresponding gray scale values, Rdiff, Gdiff, and Bdiff may be expressed with one value to be applied.

When Rdiff, Gdiff, and Bdiff are obtained for each gray scale value, it is possible to obtain a pure current value to flow in the pixels R, G, and B, except for the loading effect of the panel. For example, Rdiff, Gdiff, and Bdiff for each gray scale value of each of the red pixels R, the green pixels G, and the blue pixels B may be stored in a lookup table, and the gray scale value of data (e.g., received from an external source) may be changed based on the stored lookup table.

In one embodiment, the gray scale value of data may be changed using Rdiff, Gdiff, and Bdiff, so that a pure current, except for the loading effect, may flow. Further, it is possible to exclude the loading effect from current supplied as deviation information from external compensation, to thereby improve the accuracy of compensation.

However, when Rdiff, Gdiff, and Bdiff for each gray scale value each of the red pixels R, the green pixels G, and the blue pixels B are stored in the lookup table, memory capacity and an associated mounting area increase. Accordingly, a method for obtaining Rdiff, Gdiff, and Bdiff in the form of an equation, instead of a lookup table, may be provided in accordance with one or more embodiments.

FIG. 3 illustrates an example of current values corresponding to loading of the panel when the gray scale value of red pixels correspond to 150, the gray scale value of blue pixels correspond to 255, and the gray scale values of the green pixel change.

Referring to FIG. 3, the red pixels R emit light corresponding to a gray scale value of 150, and the blue pixels B emit light corresponding to a gray scale value of 255, and the green pixels G emit light with gray scale values that gradually decrease from 255 to 10.

When the red pixels R emit light corresponding to a gray scale value of 150, the blue pixels B emit light corresponding to a gray scale value of 255, and the green pixels G emit light corresponding to a gray scale value of 255, Wsum is set with 95.8094 nA, Rw is set with 6.0698 nA, Gw is set with 31.9698 nA, Bw is set with 57.7698 nA, and Wsc is set with 87.7698 nA. The values of the current Gw flowing when the green pixels G emit light change for different gray scale values. For example, the current Gw flowing when the green pixels G emit light corresponding to a gray scale value of 250 is set with 30.5698 nA, the current Gw flowing when the green pixels G emit light corresponding to a gray scale value of 230 is set with 24.3198 nA, and the current Gw flowing when the green pixels G emit light corresponding to a gray scale value of 30 is 0.1698 nA.

Because the current Gw flowing to the green pixels G changes based on gray scale value, the current values of Wsum and Wsc change based on the gray scale values to be expressed by the green pixels G. An example of the changed values are illustrated in FIG. 3.

When the red pixels R emit light corresponding to a gray scale value of 150, the blue pixels B emit light corresponding to a gray scale value of 255, and the green pixels G emit light corresponding to a gray scale value of 255, RofW is set with 0.0634, GofW is set with 0.3337, and BofW is set with 0.6030. When the red pixels R and the blue pixels B emit light with the aforementioned gray scale values maintained and the green pixels G emit light corresponding to a gray scale value of 250, RofW is set with 0.0643, GofW is set with 0.3238, and BofW is set with 0.6119. An example of the values of RofW, GofW, and BofW that correspond to changes in the gray scale values of the green pixels G are illustrated in FIG. 3.

When the red pixels R emit light corresponding to a gray scale value of 150, the blue pixels B emit light corresponding to a gray scale value of 255, and the green pixels G emit light corresponding to a gray scale value of 255, Rws is set with 5.5605 nA, Gws is set with 29.2871 nA, and Bws is set with 52.9222 nA. When the red pixels R and the blue pixels B emit light with the aforementioned gray scale values maintained and the green pixels G emit light corresponding to a gray scale value of 250, Rws is set with 5.5465 nA, Gws is set with 27.9342 nA, and Bws is set with 52.7891 nA. Examples of the values of Rws, Gws, and Bws corresponding to the changed gray scale values of the green pixels G are illustrated in FIG. 3.

When Rws is set with 100%, the ratio of Rw may be represented with Rdiff. Similarly, when Gws is set with 100%, the ratio of Gw may be represented with Gdiff, and when Bws is set with 100%, the ratio of Bw may be represented with Bdiff.

When the red pixels R emit light corresponding to a gray scale value of 150, the blue pixels B emit light corresponding to a gray scale value of 255, and the green pixels G emit light corresponding to a gray scale value of 255, Rdiff, Gdiff, and Bdiff are set with 109.16. When the red pixels R and the blue pixels B emit light with the aforementioned gray scale values maintained and the green pixels G emit light corresponding to a gray scale value of 250, Rdiff, Gdiff, and Bdiff are set with 109.44. When the red pixels R and the blue pixels B emit light with the aforementioned gray scale values maintained and the green pixels G emit light corresponding to a gray scale value of 150, Rdiff, Gdiff, and Bdiff are set with 105.25.

Thus, compared to FIG. 2, it can be seen that even though the gray scale values of the red pixels R change, Rdiff, Gdiff, and Bdiff may be equally set for each gray scale value (except for a gray scale value of 10 for the green pixels G).

Moreover, based on a comparison of FIGS. 2 and 3, it can be seen that the difference ratio changes for gray scale values implemented in the red pixels R, the green pixels G, and the blue pixels B. This means that loading curves are different between a case where the red pixels R, the green pixels G, and the blue pixels B are changed to the same gray scale values and a case where the red pixels R, the green pixels G, and the blue pixels B are changed to different gray scale values.

For example, changes in current flowing when the red pixels R, green pixels G, and blue pixels B are changed from gray scale values of 200, 200, 200 to gray scale values of 100, 100, 100 may correspond to a first loading curve. In contrast, changes in current flowing when the red pixels R, green pixels G, and blue pixels B are changed from the gray scale values of 100, 200, 190 to gray scale values of 200, 150, 130 may correspond to a second loading curve different from the first loading curve.

As a result, considering current efficiency of each of the red pixels R, the green pixels G, and the blue pixels B, one loading ratio current expressed as Rdiff=Gdiff=Bdiff may be calculated. For example, a current change curve of each of the red pixels R, the green pixels G, and the blue pixels B may be calculated for a fixed load.

In one embodiment, Rdiff, Gdiff, and Bdiff are equally set for a specific gray scale value. Thus, Rdiff, Gdiff, and Bdiff may correspond to a loading correction value Ldiff. The loading correction value Ldiff may be expressed based on a difference value of loading between a case where each of the red pixels R, the green pixels G, and the blue pixels B emits light and a case where all of the red pixels R, the green pixels G, and the blue pixels B emit light. Accordingly, when a loading correction value Ldiff is calculated for each gray scale value, it is possible to obtain a current value that is to flow in the pixels R, G, B, excluding differences based on loading effects.

FIG. 4 illustrating an example of current change values when gray scale values of green pixels and blue pixels are fixed and gray scale values of red pixels change.

Referring to FIG. 4, when the gray scale values of the green pixels G and the blue pixels B are set to 255 and the gray scale value of the red pixels R change to 255, 250, 230, . . . , and 10, changes in the current values of corresponding gray scale values may be expressed in the form of a quadratic equation. In this case, a gamma value of the red pixels R may be obtained based on a current change curve of the red pixels R (for example, an exponential value of a quadratic equation). In FIG. 4, a gamma value of 1.7 for the red pixels R is given as an example.

The loading correction value Ldiff in FIG. 4 is obtained based on the values of a specific panel illustrated in FIGS. 2 and 3. Here, a calculated loading correction value Ldiff(C) may corresponding to a value calculated based an equation that takes the gamma value of 1.7 of the red pixels R into consideration. The measured loading correction value Ldiff and the calculated loading correction value Ldiff(C) may be equally or similarly set (e.g., to within a predetermined tolerance or deviation). For example, a measured curve (e.g., a curve actually measured for the panel) and a calculated curve to which the gamma value of 1.7 is applied may have similar forms. An example of equation for calculating the calculated loading correction value Ldiff(C) will be described in detail below.

In the meantime, in accordance with the present embodiment, gamma values of the red pixels R may be calculated at least one time before the panel is released, for example, as illustrated in FIG. 4. The gamma values of the red pixels R may provide an indication of a process deviation.

Figure 5:
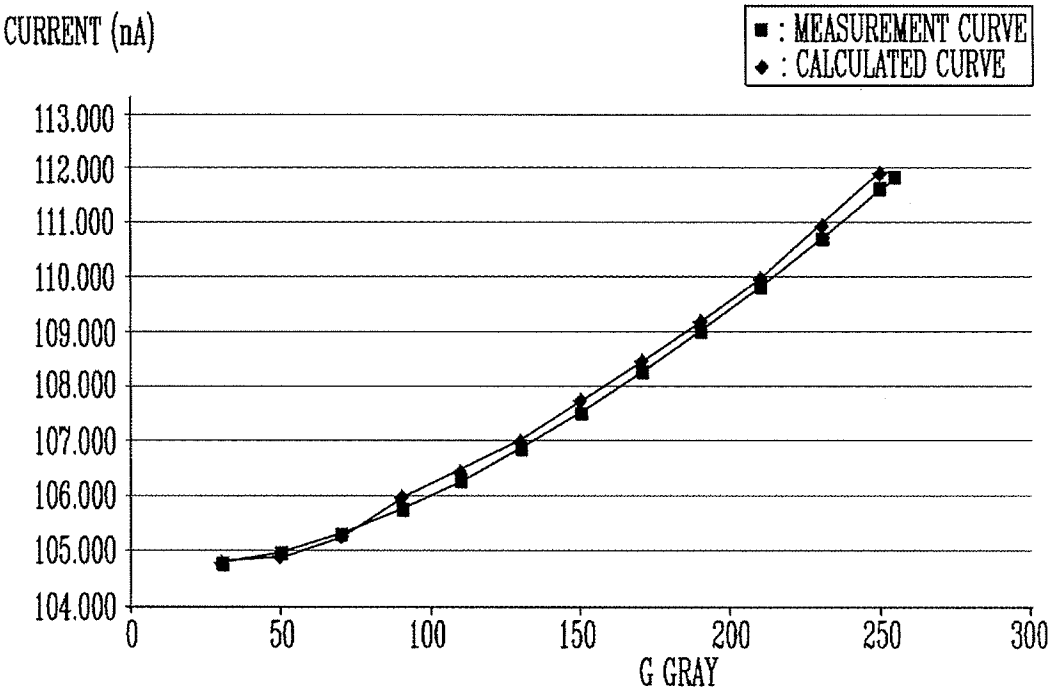
FIG. 5 illustrates an example of current change values when gray scale values of red and blue pixels are fixed and gray scale values of green pixels are different.

FIG. 5 illustrates an example of current change values when the gray scale values of red and blue pixels are fixed and the gray scale values of green pixels change.

Referring to FIG. 5, when the gray scale values of the red pixels R and blue pixels B are set to a gray scale value of 255, and the gray scale values of the green pixels G change to 255, 250, 230, . . . , and 10, the change in current values for corresponding ones of the gray scale values may be expressed in the form of a quadratic equation.

In this case, a gamma value of the green pixels G may be obtained based on a current change curve of the green pixels G (e.g., an exponential value of a quadratic equation). In FIG. 5, the gamma value of the green pixels G may be, for example, 1.5.

The loading correction value Ldiff in FIG. 5 may be obtained based on measurements for a specific panel as illustrated in FIGS. 2 and 3. A calculated loading correction value Ldiff(C) may correspond to a value calculated, for example, based on an equation that takes into consideration the gamma value of 1.5 for the green pixels G. The measured loading correction value Ldiff and the calculated loading correction value Ldiff(C) may be equally or similarly set, e.g., set to within a predetermined tolerance or deviation. In one embodiment, a measured curve (e.g., a curve that is actually measured in the panel) and a calculated curve to which the gamma value of 1.5 is applied may have similar forms. An example of an equation for calculating the calculated loading correction value Ldiff(C) will be described in detail below.

In the meantime, in the present embodiment a gamma value for the green pixels G may be calculated at least one time before the panel is released, for example, as illustrated in FIG. 5. It is therefore possible to obtain a gamma value for the green pixels G that is indicative of a process deviation.

Figure 6:
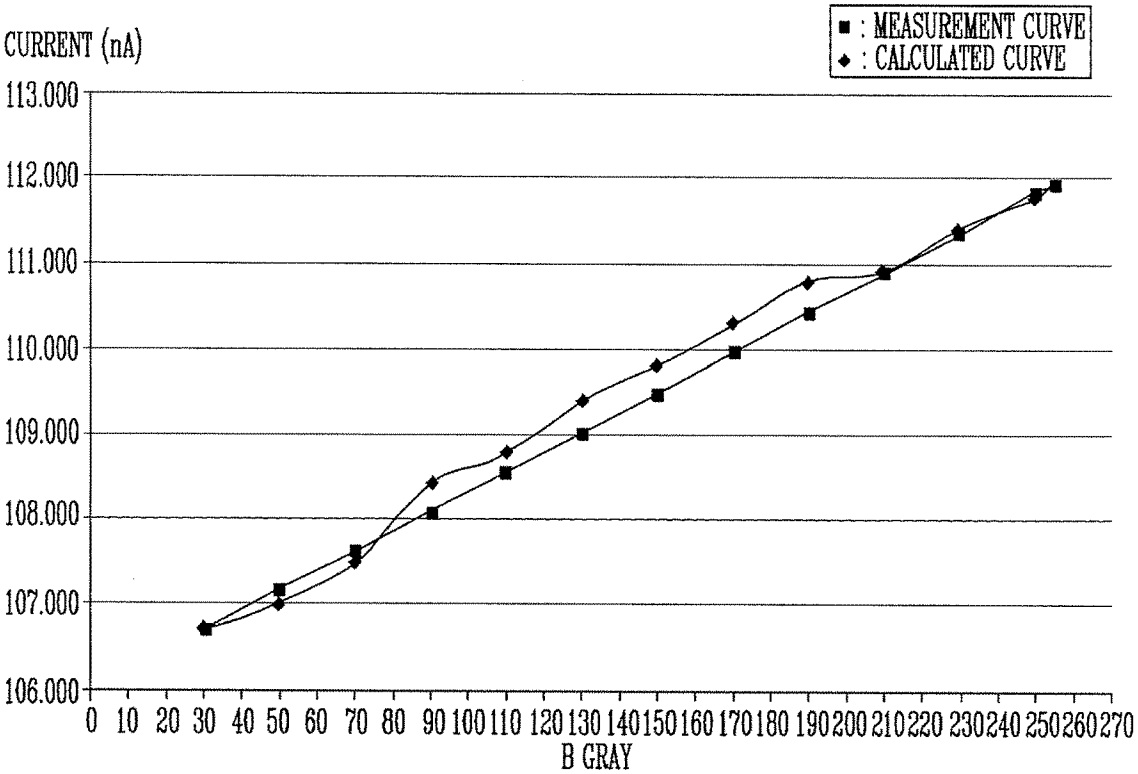
FIG. 6 illustrates an example of current change values when gray scale values of red and green pixels are fixed and gray scale values of blue pixels are different.

FIG. 6 illustrates an example of current change values when gray scale values of red pixels and green pixels are fixed and the grays scale values of the blue pixels change.

Referring to FIG. 6, when the gray scale values of the red pixels R and the green pixels G are set to 255 and the gray scale values of the blue pixels B change to 255, 250, 230, . . . , and 10, the change in current values for corresponding ones of the grays may be expressed in the form of a quadratic equation.

In this case, a gamma value of the blue pixels B may be obtained using a current change curve of the blue pixels B (e.g., an exponential value of a quadratic equation). In FIG. 6, a gamma value of the blue pixels B may be set, for example, to 1.

The loading correction value Ldiff in FIG. 6 is obtained by measuring a specific panel as illustrated in FIGS. 2 and 3. A calculated loading correction value Ldiff(C) may correspond, for example, to a value calculated by an equation which takes into consideration the gamma value of 1 for the blue pixels B. The measured loading correction value Ldiff and the calculated loading correction value Ldiff(C) may be equally or similarly set, e.g., to within a predetermined deviation or tolerance. For example, a measured curve (e.g., a curve actually measured in the panel) and a calculated curve to which the gamma value of 1 is applied may have the similar forms. An example of an equation for calculating the calculated loading correction value Ldiff(C) will be described in detail below.

In the meantime, a gamma value of the blue pixels B is calculated at least one time before the panel is released, for example, as illustrated in FIG. 6. Then, it is possible to obtain a gamma value for the blue pixels B that is indicative of a process deviation.

In order to obtain the loading correction value using the gamma value of each of the pixels R, G, and B obtained by FIGS. 4 to 6, a multi-order equation of a three or more order equation may be used. In some cases, it may be difficult to implement a multi-order equation (e.g., a three or more order equation) with hardware. Also, the mounting area for such hardware may also be increased in order to implement such an equation. In the present embodiment, the loading correction value Ldiff is obtained using three simple equations.

FIG. 7 illustrates information which may be used to express an equation for obtaining a locating correction value using a gamma value, extracted from FIGS. 4 to 6. A lookup table of FIG. 7 may be stored in a memory of an organic light emitting display device and the like.

Referring to FIG. 7, a loading correction value Ldiff when the red pixels R, the green pixels G, and the blue pixels B emit light of a first gray scale value, and a loading correction value Ldiff when any one of the red pixels R, the green pixels G, or the blue pixels B emits light of a second gray scale value, and the remaining pixels (two of R, G, or B) emit light in the first gray scale value are stored in a memory. The lookup table that stores loading correction values Ldiff based on gray scale values may be referred to as a first lookup table.

The first gray scale value may be set with the highest gray scale value implementable in the pixels R, G, and B. The second gray may be set with any one gray scale value between an intermediate gray scale value and the lowest gray scale value implementable in the pixels R, G, and B. For example, the first gray scale value may be 255 and the second gray scale value may between gray scale values of 20 and 50 (e.g., a gray scale value of 30), taking the current sensing accuracy of measurement equipment into consideration.

When the second gray scale value is set with the lowest gray value (e.g., 0), the current sensing accuracy of measurement equipment may be degraded. Consequently, the accuracy of the calculated loading correction value Ldiff(C) may be degraded. Accordingly, in the present embodiment, the second gray scale value is set between an intermediate gray value and the lowest gray value. As a result, it is possible to improve the accuracy of the calculated loading correction value Ldiff(C).

The gamma values of the red pixels R, the green pixels G, and the blue pixels B set in FIGS. 4 to 6 may also be stored in the memory. A lookup table storing the gamma values may be referred to as a second lookup table.

The organic light emitting display device may calculate a calculated loading correction value Ldiff(C) for each gray scale value using the first lookup table and the second lookup table. For example, a processor, controller, or logic of the organic light emitting display device may calculate a loading correction value Ldiff for each gray scale value of the pixels using Equations 1 to 3.

$$Cal1=(Ldiff_{maxR}-Ldiff_{minR})\times((GrayR-Gray_{min})/(Gray_{max}-Gray_{min}))^{Rgamma}+Ldiff_{minR} \quad (1)$$

$$Cal2=(Cal1-Ldiff_{minG}\times(Cal1/Ldiff_{maxR}))\times((GrayG-Gray_{min})/(Gray_{max}-Gray_{min}))^{Ggamma}+(Ldiff_{minG}\times(Cal1/Ldiff_{maxR})) \quad (2)$$

$$Cal3(Ldiff(C))=(Cal2-Ldiff_{minB}\times(Cal2/Cal1))\times((GrayB-Gray_{min})/(Gray_{max}-Gray_{min}))^{Bgamma}+(Ldiff_{minB}\times(Cal2/Cal1)) \quad (3)$$

In Equation 1, $Ldiff_{maxR}$ corresponds to a loading correction value Ldiff when the red pixel R has the first gray scale value, $Ldiff_{minR}$ corresponds to a loading correction value Ldiff when the red pixel R has the second gray scale value, GrayR corresponds to a gray value of data currently input into the red pixel R, $Gray_{min}$ corresponds to a second gray scale value, $Gray_{max}$ corresponds to a first gray scale value, and Rgamma corresponds to a gamma value of the red pixel R.

In Equation 2, $Ldiff_{minG}$ corresponds to a loading correction value Ldiff when the green pixel G has the second gray scale value, GrayG corresponds to a gray scale value of data currently input into the green pixel G, and Ggamma corresponds to a gamma value of the green pixel G.

In Equation 3, $Ldiff_{minB}$ corresponds to a loading correction value Ldiff when the blue pixel B is in the second gray scale value, GrayB corresponds to a gray value of data currently input into the blue pixel B, and Bgamma corresponds to a gamma value of the blue pixel B.

FIG. 8 illustrates a difference between a measured loading correction value and a calculated loading correction value according to an embodiment when the gray scale values of red and blue pixels are fixed and the gray scale values of green pixels change.

Referring to FIG. 8, the red pixels R and blue pixels B emit light corresponding to a gray scale value of 255 and the gray scale values of the green pixels G gradually decrease from 255 to 10. In this case, a loading correction value Ldiff(C) may be calculated using Equation 1 (Cal1) to Equation 3 (Cal3).

When the gray scale values of the red pixels R, the green pixels G, and the blue pixels B are 255, Equation 1 is calculated as (111.877−107.575)×((255−30)/(255−30))^1.7+107.576, and thus is set with 111.88.

When the gray scale values of the red pixels R, the green pixels G, and the blue pixels B are 255, Equation 2 is calculated as (111.88−104.802)×(111.88/111.88)×((255−30)/(255−30))^1.5+(104.802×(111.88/111.88)), and thus is set with 111.88.

When gray scale values of the red pixels R, the green pixels G, and the blue pixels B are 255, Equation 3 is calculated as ((111.88−106.695)×(111.88/111.88)×((255−30)/(255−30))^1+(106.695×(111.88/111.88)), and thus is set with 111.88.

When the gray scale values of the red pixels R and blue pixels B are 255 grays and the gray scale value of the green pixels G is 250, Equation 2 is calculated as (111.88−(104.802×111.88/111.88))×((250−30)/(255−30))^1.5+(104.802×111.88/111.88), and thus is set with 111.64.

When the gray scale values of the red pixels R and the blue pixels B are 255 grays and the gray scale value of the green pixels G is 250, Equation 3 is calculated as (111.64−106.695×(111.64/111.88))×((255−30)/255−30))^1+(106.695×(111.64/111.88)), and thus is set with 111.64.

Thus, the calculated loading correction value Ldiff(C) is calculated as illustrated in FIG. 8 by Equations 1 to 3. When the calculated loading correction value Ldiff(C) calculated by Equations 1 to 3 is compared with the measured loading correction value Ldiff, there is an error within about 1%.

As described above, when the calculated loading correction value Ldiff(C) is obtained, it is possible to remove a loading effect of the panel using the calculated loading correction value Ldiff(C). For example, Rws, Gws, and Bws may be obtained from Rw, Gw, and Bw using the calculated loading correction value Ldiff(C). Accordingly, when the present embodiment is applied, the accuracy of compensation may be improved by removing the loading effect from the external compensation. Further, when the present embodiment is applied, data may be compensated so that a desired current may flow in the pixels by removing the loading effect of the panel.

FIG. 9 illustrates another exemplary embodiment corresponding to a difference between a measured loading correction value and a calculated loading correction value when the gray scale values of red and blue pixels are fixed and the gray scale values of green pixels change.

Referring to FIG. 9, the red pixels R emit with a gray scale value of 255, the blue pixels B emit light with a gray scale value of 170, and the gray scale values of the green pixels G decrease from 255 to 10. In this case, a calculated loading correction value Ldiff(C) is obtained by Equations 1 to 3. When the calculated loading correction value Ldiff(C) calculated by Equations 1 to 3 is compared with the actually measured loading correction value Ldiff, there is an error within about 1%.

Figure 10:
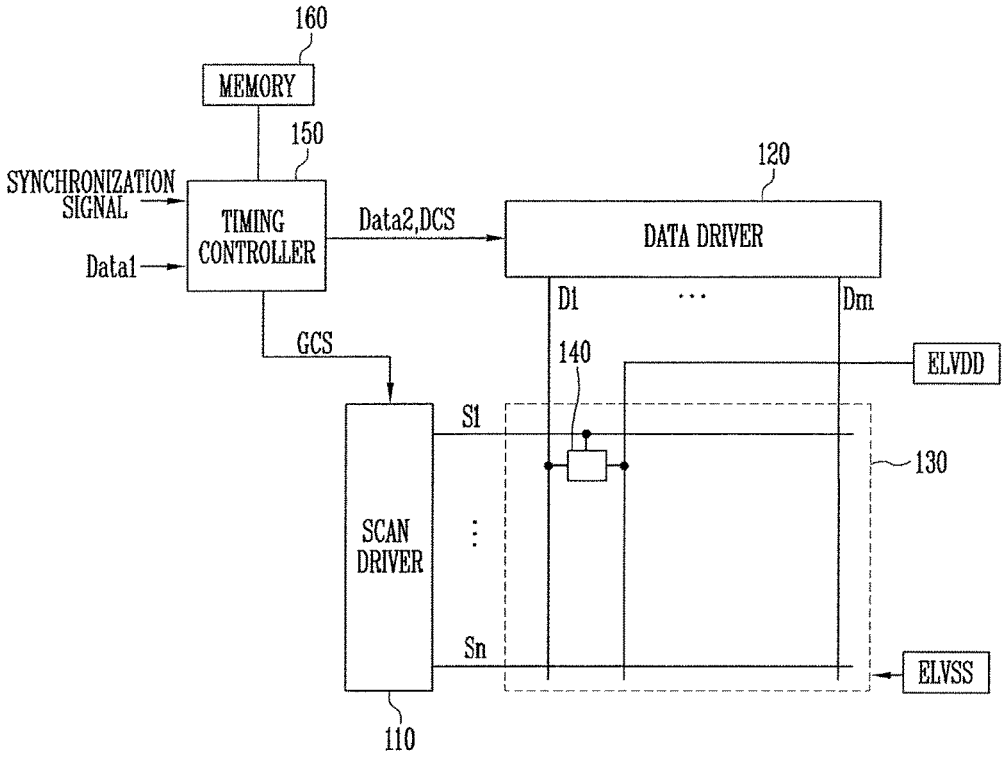
FIG. 10 illustrates an embodiment t of an organic light emitting display device.

FIG. 10 illustrates an embodiment of an organic light emitting display device which includes a pixel unit 130 including pixels 140 in regions divided by scan lines S1 to Sn and data lines D1 to Dm, a scan driver 110 for driving the scan lines S1 to Sn, a data driver for driving data lines D1 to Dm, a timing controller 150 for controlling the scan driver 110 and the data driver 120, and a memory 160.

The scan driver 110 supplies a scan signal to the scan lines S1 to Sn based on a gate control signal GCS. For example, the scan driver 110 may sequentially supply a scan signal to the scan lines S1 to Sn.

The data driver 120 supplies a data signal to the data lines D1 to Dm based on a data control signal DCS. The data signal supplied to the data lines D1 to Dm is supplied to the selected pixels 140 by the scan signal.

The pixel unit 130 includes the pixels 140 in the regions divided by the scan lines S1 to Sn and the data line D1 to Dm. The pixels 140 are selected when the scan signal is supplied and stores the data signal from the data lines D1 to Dm. The pixels 140 storing the data signal generates light with predetermined luminance while controlling the amount of current flowing from a first power source ELVDD to a second power source ELVSS, via an organic light emitting diode, based on the data signal.

The memory 160 stores the first lookup table and the second lookup table in FIG. 7 and Equations 1 to 3.

The timing controller 150 generates a gate control signal GCS and a data control signal DCS based on synchronization signals received from an external source. Further, the timing controller 150 may change first data Data1 based on the information stored in the memory 160 and generate second data Data2.

For example, the timing controller 150 calculates a calculated loading correction value Ldiff(C) using gray scale information (gray scale information of data to be supplied to the red, green, and blue pixels) of the first data Data1 and the information stored in the memory 160. The timing controller 150, obtains the calculated loading correction value Ldiff (C), changes the first data Data1 so that a loading effect is removed, and generates the second data Data2. In this case, a desired current may flow in the pixel unit 130 regardless of the loading effect, thereby improving display quality.

Figure 11:
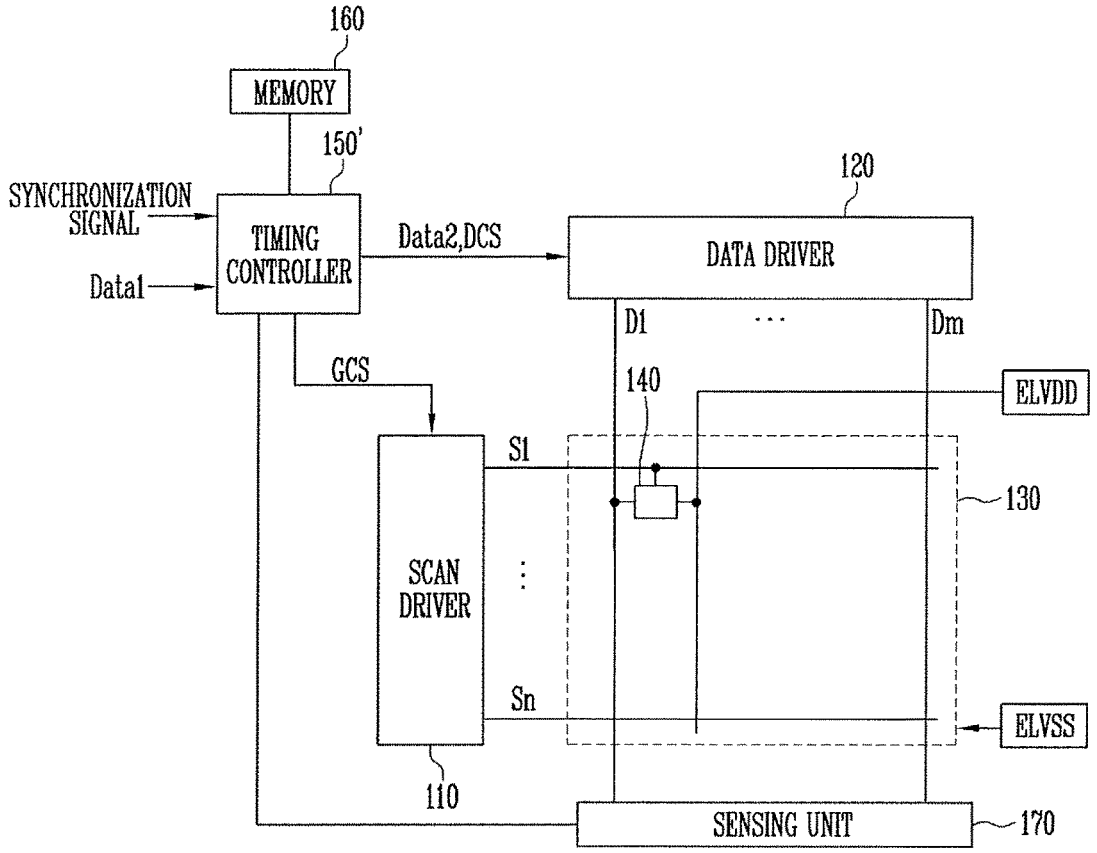
FIG. 11 illustrates another embodiment of organic light emitting display device.

FIG. 11 illustrates another embodiment of an organic light emitting display device which includes a sensing unit 170. The sensing unit 170 extracts at least one of degradation information of an organic light emitting diode in each of the pixels 140 or threshold voltage deviation information of a driving transistor in each of the pixels 140. For example, the sensing unit 170 may extract at least one of the degradation information or the deviation information in the form of a current.

A timing controller 150' may extract pure information, in which a loading effect is excluded, from the degradation information and/or the deviation information supplied from the sensing unit 170. For example, the data signal having a gray scale value of 255 is supplied to the red pixels, and a current flowing in the red pixel based on the gray scale value of 255 may be supplied to the sensing unit 170 as the deviation information.

The timing controller 150 calculates a calculated loading correction value Ldiff(C) using the gray scale information of the red pixel and the information stored in the memory 160, and thus may exclude the loading effect from the current of the deviation information. In this case, it is possible to improve accuracy during an external compensation, thereby improving compensation performance.

Figure 12:
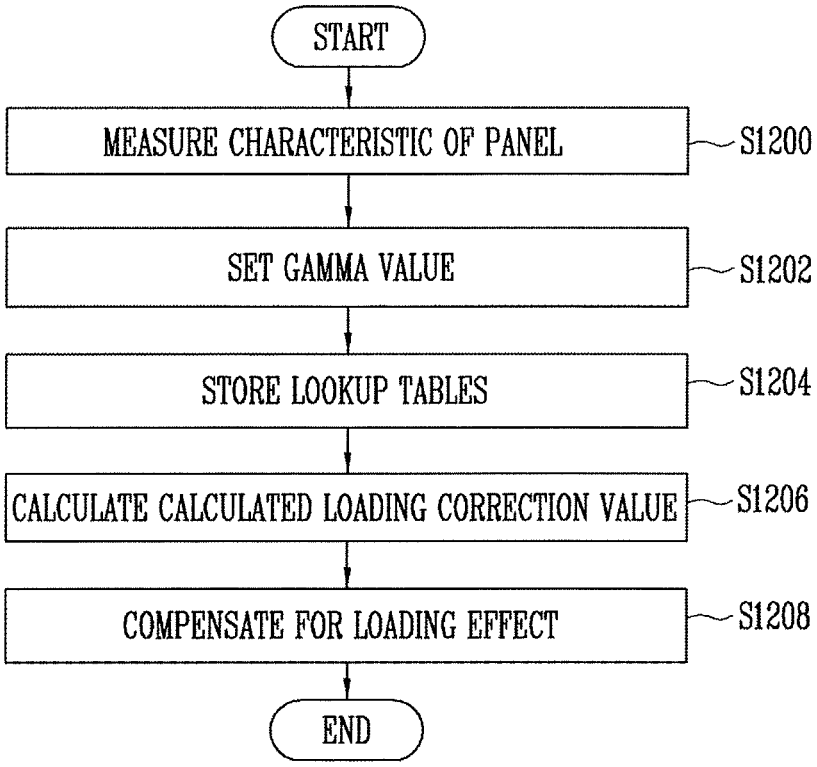
FIG. 12 illustrates an embodiment of a method for driving an organic light emitting display device.

FIG. 12 illustrates an embodiment of a method for driving an organic light emitting display device.

Measure a Characteristic of a Panel: S1200

First, a characteristic of the panel is measured before the panel is released. For example, as illustrated in FIGS. 2 and 3, current values (e.g., Wsum and Wsc) corresponding to the characteristic of the panel may be measured. Thus, a measured loading correction value Ldiff (as illustrated in FIGS. 4 to 6) may be measured.

Set a Gamma Value: S1202

After the measured loading correction value Ldiff is measured, a gamma value of each of the red pixels R, the green pixels G, and the blue pixels B is set as illustrated, for example, in FIGS. 4 to 6. The gamma values set in operation S1202 are values reflecting a process error of the panel. Thus, the gamma values may be differently set for each panel.

Store Lookup Tables: S1204

After the gamma value of each of the red pixels R, the green pixels G, and the blue pixels B is set, a first lookup table and a second lookup table (e.g., as in FIG. 7) are stored in the memory 160. Further, first to third equations are stored in the memory 160.

Calculate a Calculated Loading Correction Value: S1206

Then, the timing controller 150 and 150' calculates the calculated loading correction value Ldiff(C) using gray scale values of data, for example, supplied from an external source or gray scale values of data used in an external compensation.

Compensate for a Loading Effect: S1208

After the calculated loading correction value Ldiff(C) is obtained, the timing controller 150 and 150' may generate second data Data2 by correcting first data Data1, or may remove a loading effect from a current supplied as deviation information during the external compensation. Additionally, the second data Data2 generated in operation S1208 is set so that a current, in which the loading effect is removed, may flow in the pixels R, G, and B.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The controllers, processors, calculators, equation generators, and other processing features of the embodiments disclosed herein may be implemented in logic which, for example, may include hardware, software, or both. When implemented at least partially in hardware, the controllers, processors, calculators, equation generators, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, processors, calculators, equation generators, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A method for driving an organic light emitting display device, comprising:

measuring a characteristic of a panel;

storing a measured loading correction value in a first lookup table, the measured loading correction value including loading information of red pixels, green pixels, and blue pixels that correspond to predetermined gray scale values based on the characteristic of the panel;

storing a first gamma value of the red pixels corresponding to the characteristic of the panel, a second gamma value of the green pixels corresponding to the characteristic of the panel, and a third gamma value of the blue pixels corresponding to the characteristic of the panel in a second lookup table; and obtaining a calculated loading correction value based on pre-stored equations, the first lookup table, and the second lookup table, the calculated loading correction value including loading information corresponding to gray scale values different from the predetermined gray scale values.

2. The method as claimed in claim 1, wherein the measured loading correction value and the calculated loading correction value include difference information between a loading value when all of the red pixels, the green pixels, and the blue pixels emit light and a loading value when each of the red pixels, the green pixels, and the blue pixels emits light.

3. The method as claimed in claim 2, wherein difference information between a first current flowing when all of the red pixels, the green pixels, and the blue pixels emit light and second currents flowing when each of the red pixels, the green pixels, and the blue pixels emits light corresponds to the measured loading correction value.

4. The method as claimed in claim 1, wherein the first gamma value is generated based on a measurement curve of a current change that corresponds to a gray scale value change of the red pixels when gray scale values of the green pixels and the blue pixels are fixed.

5. The method as claimed in claim 1, wherein the second gamma value is generated based on a measurement curve of a current change that corresponds to a gray scale value change of the green pixels when gray scale values of the red pixels and the blue pixels are fixed.

6. The method as claimed in claim 1, wherein the third gamma value is generated based on a measurement curve of a current change that corresponds to a gray scale value change of the blue pixels when grays of the red pixels and the green pixels are fixed.

7. The method as claimed in claim 1, wherein the first lookup table includes:

a first measured loading correction value when the red pixels, the green pixels, and the blue pixels emit light of a first gray scale value, and second measured loading correction values when any one of the red pixels, the green pixels, or the blue pixels emit light of a second gray scale value and remaining ones of the pixels emit light of the first gray scale value.

8. The method as claimed in claim 7, wherein:

the first gray scale value is set with a highest gray value, and the second gray scale value is set with a gray scale value between an intermediate gray value and a lowest gray value.

9. The method as claimed in claim 8, wherein when a maximum gray scale value is 255:

the first gray scale value corresponds to 255, and the second gray scale value is between 20 to 50.

10. The method as claimed in claim 7, wherein the calculated loading correction value is based on the following equations:

$$Cal1=(Ldiff_{maxR}-Ldiff_{minR})\times((GrayR-Gray_{min})/(Gray_{max}-Gray_{min}))^{Rgamma}+Ldiff_{minR}$$

where $Ldiff_{maxR}$ corresponds to a first measured loading correction value of the red pixels, $Ldiff_{minR}$ corresponds to a second measured loading correction value of the red pixels, GrayR corresponds to a gray value of data currently input into the red pixels, $Gray_{min}$ corresponds to the second gray value, $Gray_{max}$ corresponds to the first gray value, and Rgamma corresponds to the first gamma value, $$Cal2=(Cal1-Ldiff_{minG}\times(Cal1/Ldiff_{maxR}))\times((GrayG-Gray_{min})/(Gray_{max}-Gray_{min}))^{Ggamma}+(Ldiff_{minG}\times(Cal1/Ldiff_{maxR}))$$

where $Ldiff_{minG}$ corresponds to a second measured loading correction value of the green pixels, GrayG corresponds to a gray value of data currently input into the green pixels, and Ggamma corresponds to the second gamma value, $$Cal3(Ldiff(C))=(Cal2-Ldiff_{minB}\times(Cal2/Cal1))\times((GrayB-Gray_{min})/(Gray_{max}-Gray_{min}))^{Bgamma}+(Ldiff_{minB}\times(Cal2/Cal1))$$

where $Ldiff_{minB}$ corresponds to a second measured loading correction value of the blue pixels, GrayB corresponds to a gray value of data currently input into the blue pixels, and Bgamma corresponds to the third gamma value.

11. The method as claimed in claim 1, further comprising:

generating second data by changing a bit of first data supplied from an external source based on the calculated loading correction value.

12. The method as claimed in claim 1, further comprising:

calculating a current, in which a loading effect is excluded, from a current supplied from the pixels based on the calculated loading correction value.

13. A method for driving a display, comprising:

measuring a first loading correction value corresponding predetermined gray scale values of pixels;

obtaining gamma values for the pixels;

calculating a second loading correction value corresponding to gray scale values different from the predetermined gray scale values; and generating current for emitting light from the pixels based on the second loading correction value, wherein the second loading correction value is calculated based on the first loading correction value and the gamma values and wherein the current excludes a component corresponding to a loading effect.

* * * * *